US010729292B2

(12) United States Patent
Duffee et al.

(10) Patent No.: US 10,729,292 B2
(45) Date of Patent: Aug. 4, 2020

(54) SEAT FOR PORTABLE TOILET WITH TANK-BLOCKING SHUTTER

(71) Applicant: PaPa Squat Port A Pot, LLC, Coudersport, PA (US)

(72) Inventors: Kirk Duffee, Coudersport, PA (US); Kevin Genevro, St. Mary's, PA (US)

(73) Assignee: PaPa Squat Port A Pot, LLC, Coudersport, PA (US)

( * ) Notice: Subject to any disclaimer, the term of this patent is extended or adjusted under 35 U.S.C. 154(b) by 340 days.

(21) Appl. No.: 15/251,117

(22) Filed: Aug. 30, 2016

(65) Prior Publication Data

US 2017/0071425 A1 Mar. 16, 2017

Related U.S. Application Data

(60) Provisional application No. 62/216,429, filed on Sep. 10, 2015.

(51) Int. Cl.
*A47K 13/24* (2006.01)
*A47K 17/00* (2006.01)

(52) U.S. Cl.
CPC ..... *A47K 13/24* (2013.01); *A47K 17/00* (2013.01)

(58) Field of Classification Search
CPC ..... A47K 13/24
USPC ..... 4/440, 441–442, 434–439, 449, 4/111.1–111.6, 450–486
See application file for complete search history.

(56) References Cited

U.S. PATENT DOCUMENTS 3,566,418 A * 3/1971 Carlson et al. ..... E03D 11/10 16/307
3,599,582 A * 8/1971 Lagstrom ..... A47K 11/023 110/159
3,837,012 A * 9/1974 Rassbach ..... A47K 11/023 4/111.3
2015/0305580 A1 10/2015 Likewise et al.

* cited by examiner

*Primary Examiner* — Christine J Skubinna
(74) *Attorney, Agent, or Firm* — Wendy W. Koba

(57) ABSTRACT

An apparatus in the form of a separate "shutter" system is disposed below and attached to the opening of a portable toilet seat in a manner that substantially blocks the underlying tank from view, yet allows for the waste material to easily pass into the tank. The system shutter assembly includes an inverted-V shaped component that is suspended below the toilet opening to block the view of an underlying pit tank while allowing for waste material to pass over either side of the "V" and fall into the tank (also protects user from any waste material splashing upward). The assembly further includes a shutter support assembly connected between the toilet seat opening and the shutter and is used to support the shutter in its suspended place. The shutter may be fixed in place, or permitted to swing back and forth as the waste material encounters the shutter.

10 Claims, 5 Drawing Sheets

SEAT FOR PORTABLE TOILET WITH TANK-BLOCKING SHUTTER

CROSS-REFERENCE TO RELATED APPLICATIONS

This application claims the benefit of U.S. Provisional Application Ser. No. 62/216,429, filed Sep. 10, 2015 and herein incorporated by reference

TECHNICAL FIELD

The present invention relates to portable toilet facilities and, particularly, to a shutter device that blocks the view of the tank from the user.

BACKGROUND OF THE INVENTION

There are many instances where the need for temporary, portable toilet facilities is desirable. Events such as fairs, concerts, and the like often make use of portable facilities. Campgrounds and similar locations may use a "pit" toilet, while not being portable is also not flushable.

In these cases where the waste is not flushed away into a remote sewer or septic system, the situation is likely to occur where the refuse collecting in the tank is visible to the users. This is obviously an unsightly situation, as well as creating odor and possibly leading to an unsanitary situation. Indeed, it is possible that some of the waste already collected in the tank may splash upward and contact a person using the portable toilet—an unacceptable possibility.

SUMMARY OF THE INVENTION

The needs remaining in the prior art are addressed by the present invention, which relates to portable toilet facilities and, more particularly, to a separate "shutter" system that is disposed below and attached to a toilet seat in a manner that substantially blocks the underlying tank from view, yet allows for the waste material to easily pass into the tank. The shutter also eliminates the possibility of any waste already collected in the tank from splashing in a manner that contacts the user.

In accordance with the present invention, an exemplary toilet system shutter assembly includes an inverted-V shaped component that is suspended below the toilet opening in a manner that essentially blocks the view to the underlying pit tank, yet allows waste material to pass over either side of the "V" and fall into the tank. The assembly further includes a flange element for mounting on the toilet opening and a shutter support assembly connected between the flange and the inverted-V shaped shutter, where the dimensions of the shutter support assembly dictate how far below the seat the shutter will be suspended.

In one embodiment of the present invention, the shutter is fixedly attached to the shutter support assembly and remains immobile (preferably, press-fit into place so that it can be removed under force for repair/maintenance functions). In another embodiment, the shutter is attached to the support assembly via a configuration that allows for the shutter to swing back and forth when waste material comes into contact with one of the sides of the "V". In either case, when not in use the shutter will block the view of the tank from an individual entering the portable toilet facility.

One particular configuration of the present invention utilizes a funnel-like base as the support assembly, providing a "closed" element that keeps the waste material confined and is inwardly tapered to direct the waste material toward the shutter. Another configuration utilizes a pair of brackets to suspend the shutter (either fixedly or capable of rotating) below the seat. In any case, the shutter prevents any previously-collected waste material from splashing upward and contacting an individual using the portable toilet.

One particular embodiment of the present invention may be defined as a shutter assembly for use with a portable toilet, the shutter assembly comprising: a flange apparatus for mounting the shutter assembly in place within an opening of a portable toilet; an inverted V-shaped shutter suspended underneath the opening of the portable toilet so as to block a view of an underlying tank; and a shutter support assembly connected between the flange apparatus and the inverted-V shutter for supporting the inverted-shaped shutter in its suspended position underneath the toilet seat opening.

Other and further aspects and embodiments of the present invention will become apparent during the course of the following discussion and by reference to the accompanying drawings.

BRIEF DESCRIPTION OF THE DRAWINGS

Referring now to the drawings, where like numerals represent like parts in several views.

DETAILED DESCRIPTION

Figure 1:
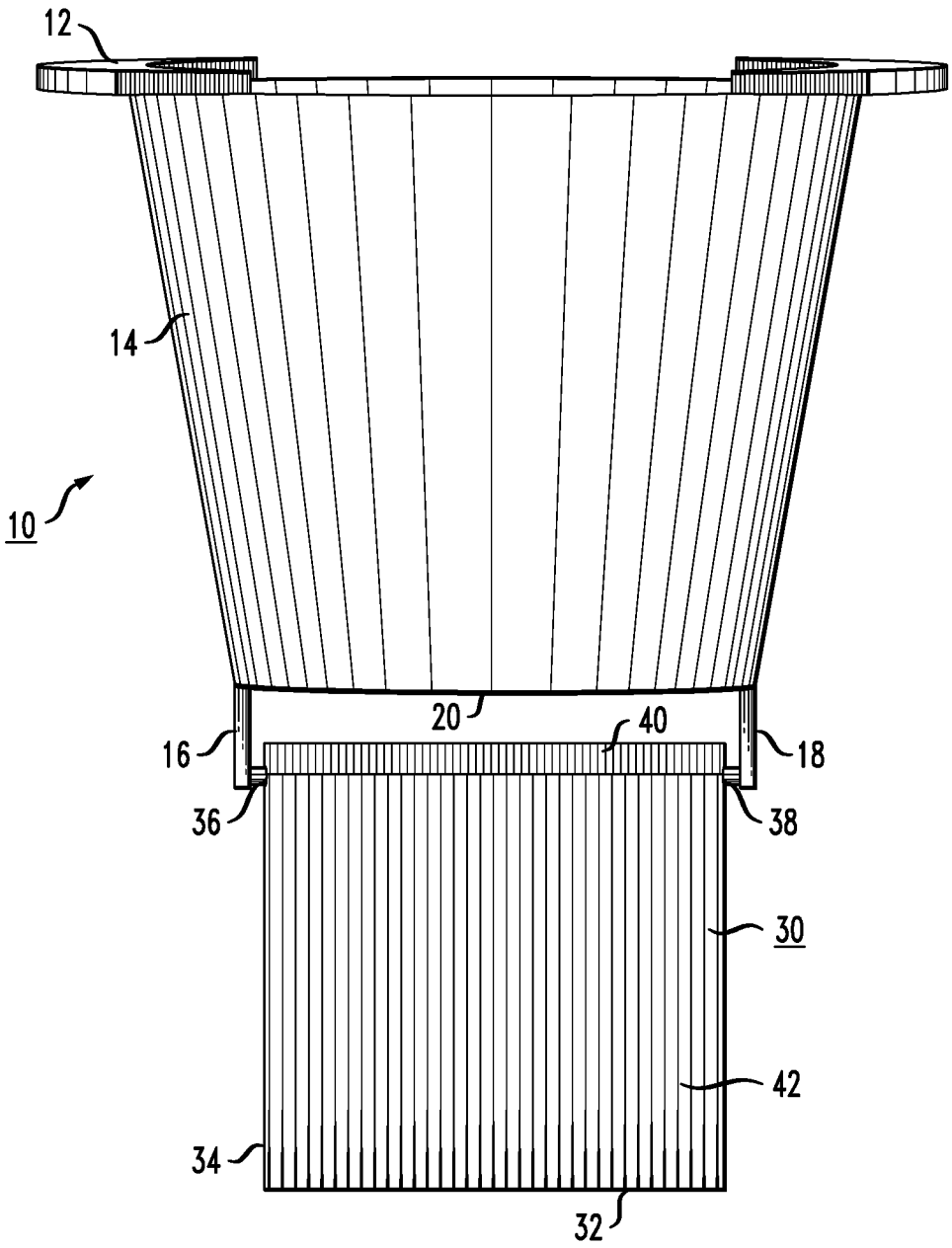
FIG. 1 illustrates an exemplary toilet seat shutter apparatus formed in accordance with the present invention.

FIG. 1 illustrates an exemplary toilet seat shutter apparatus 10 formed in accordance with the present invention. As shown, toilet seat shutter apparatus 10 comprises a seat flange 12 that is sized to fit around the designated opening to be used as the toilet area. In this particular embodiment, toilet seat shutter apparatus 10 further includes a shutter support assembly 14 in the form of a funnel-like base component. FIG. 1 illustrates base 14 as being attached to the underside of flange 12, while extending downward and tapering inward. A pair of L-shaped of pins 16, 18 is shown as extending downward from a lower termination 20 of base 14.

In accordance with this embodiment of the present invention, an inverted-V shaped shutter 30 (the shape of shutter 30 best shown in FIG. 3), engages with pins 16, 18 in a manner where the end terminations 32, 34 of shutter 30 extend downward and away from base 14. A pair of apertures 36, 38 is formed along join spine 40 of shutter 30, where apertures 36, 38 mate with pins 16, 18 to position shutter 30 in a suspended location underneath of the toilet seat opening.

Figure 2:
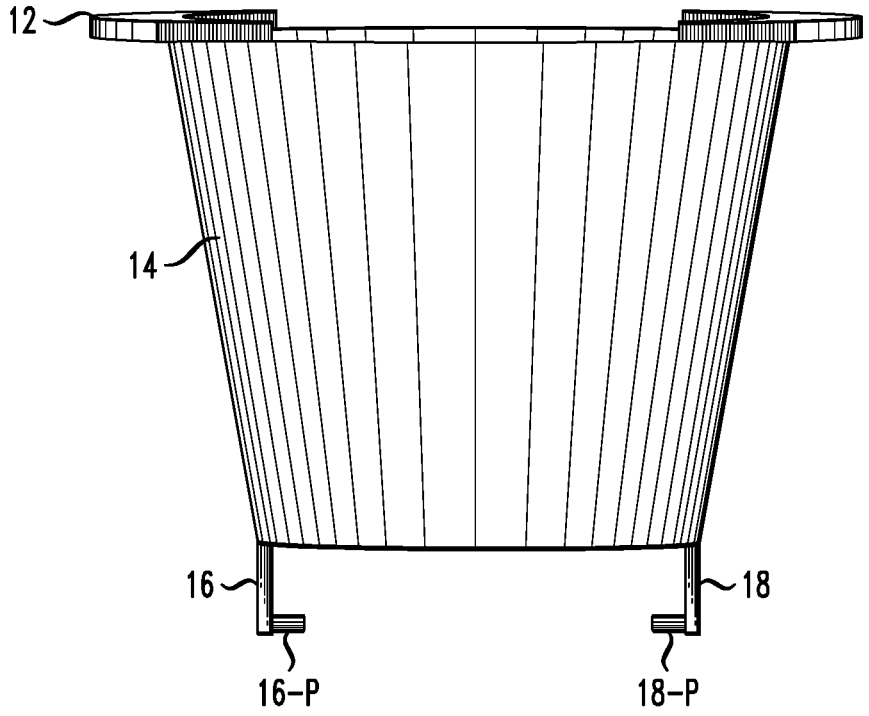
FIG. 2 is a view of the shutter support assembly component of the embodiment of the present invention as shown in FIG. 1.

FIG. 2 illustrates base component 14 of toilet seat shutter apparatus 10 (shutter 30 removed for the sake of clarity). Here, the specific configuration of L-shaped pins 16 and 18 is clearly shown. In accordance with this exemplary embodiment of the present invention, each pin includes a horizontal projection component P (denoted as 16-P and 18-P in FIG. 2). Apertures 36 and 38 of shutter 30 are sized so as to engage with pin projections 16-P and 18-P, respectively, and hold shutter 30 suspended in place below lower termination 20 of base 14.

Figure 4:
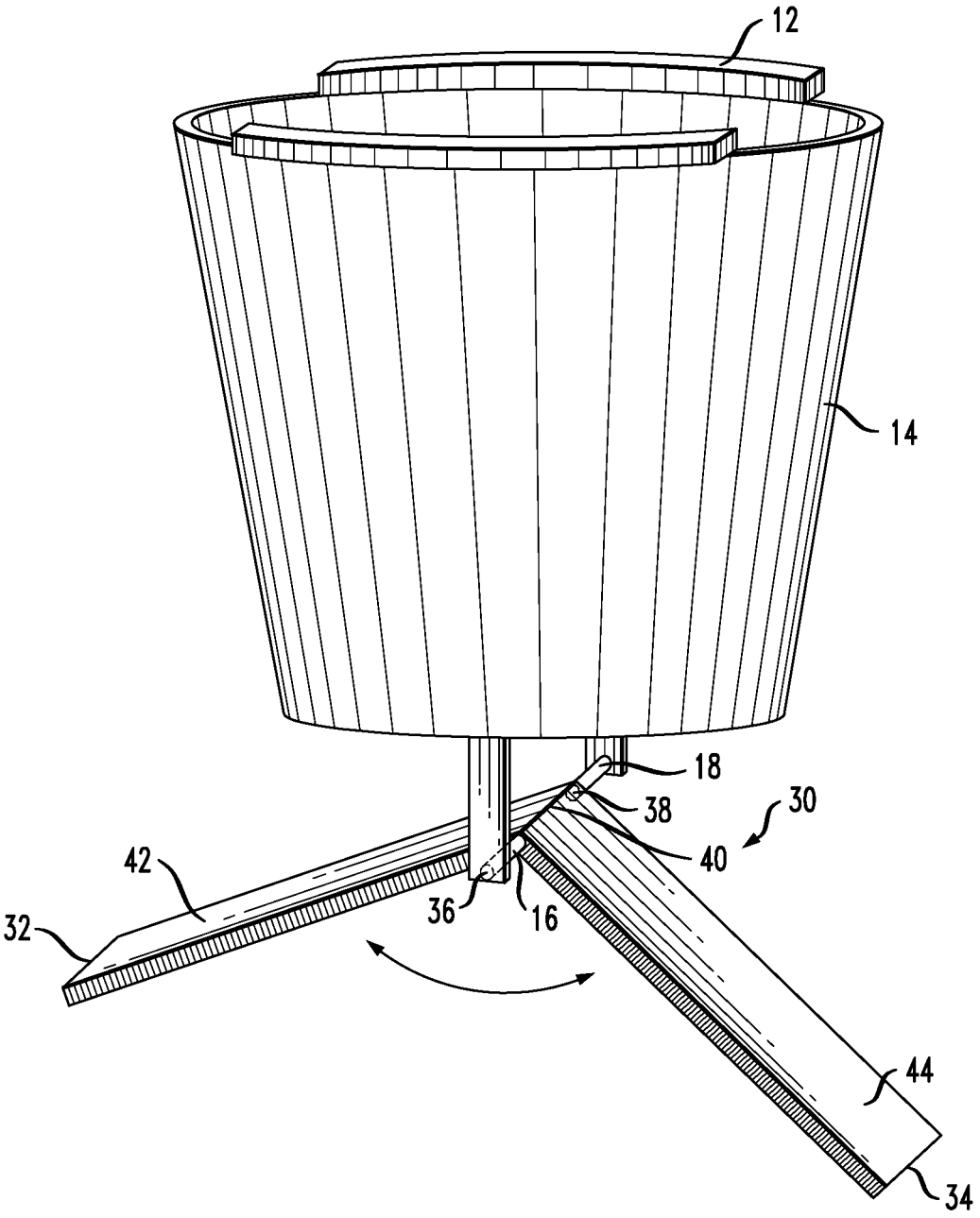
FIG. 4 is an isometric view of the exemplary toilet seat shutter apparatus as shown in FIG. 1, with this view illustrating the disposition of the shutter with respect to the support assembly and, for this embodiment, the capability for the shutter to swing back and forth in its suspended position.

In one exemplary embodiment, the connection between pins 16, 18 and apertures 36, 38 is configured so that shutter 30 is not permanently affixed in place. That is, shutter 30 remains free to swing back and forth (i.e., rock back and forth with respect to spine 40) when a force is applied to either side surface 42 or side surface 44 of shutter 30 (for example, when waste material contacts either side surface 42 or side surface 44). FIG. 4 is an isometric view of toilet seat shutter apparatus 10, where the swinging movement of shutter 30 is indicated by the double-ended arrow.

In an alternative embodiment, shutter 30 may be configured to remain fixed in place (i.e., is immobile and cannot rock back and forth). In this embodiment, the waste material will still be deflected by side surfaces 42, 44 and enter the tank below the seat. In a preferred configuration of this alternative embodiment, shutter 30 is removably attached to pin projections 16-P, 18-P to allow for servicing, repair, and/or replacement.

Figure 5:
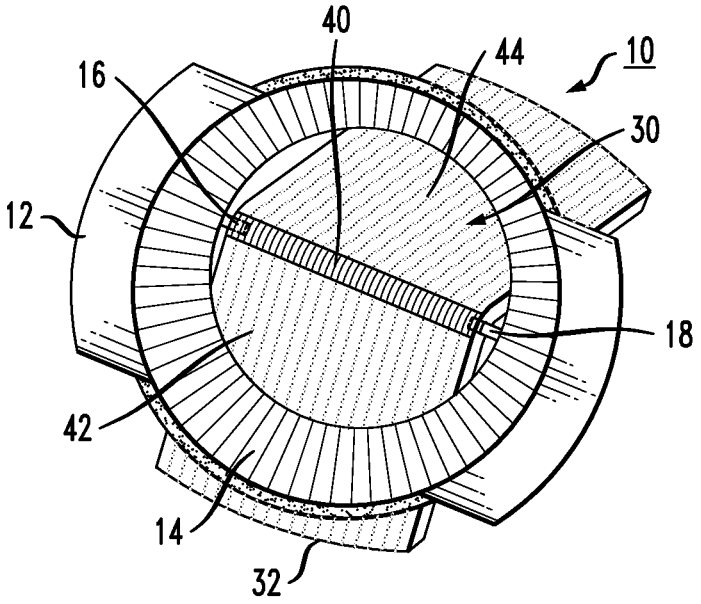
FIG. 5 is a top view of the exemplary toilet seat shutter apparatus as shown in FIG. 1, with this view illustrating the ability of the shutter to block the view of the pit tank that would be located beneath the toilet seat.

Returning to the description of the embodiment where shutter 30 is free to swing back and forth in its suspended position, it is obvious that when no force is applied to shutter 30 (e.g., when an individual enters a stall but has not begun to use the toilet), shutter 30 remains in place and blocks the view of the underlying tank. This "blocking" feature of the apparatus of the present invention is best shown in FIG. 5, which is a top view of toilet seat shutter apparatus 10. While blocking the view of the underlying tank, it is to be understood that the positioning of shutter 30 also prevents a portion of the tank odor from rising about the position of the shutter. The inclusion of the inventive shutter assembly in a conventional portable toilet is thus seen as advantageous in terms of both improving the appearance and the odor of the toilet housing.

While the embodiment described thus far illustrates shutter 30 as including a pair of apertures and base 14 as including a pair of pins, it is to be understood that the apertures may be formed along the end terminations of elements 16, 18 and pin projections formed along end terminations of spine 40 of shutter 30. In either case, the configurations may be designed to maintain the shutter fixed in position, or free to rock back and forth.

When being used in the embodiment where shutter 30 is free to move, the force of the waste material against either side surface 42 or 44 will cause shutter 30 to swing out of the way, as shown in FIG. 4, and allow the waste material to fall into the tank without any problems. When finished, shutter assembly 30 will naturally return to its balanced position and again block the tank from view, as shown in FIG. 5. Alternatively, if shutter assembly 30 remains fixed in place, the waste material will be deflected by side surfaces 42, 44 and enter the tank.

Figure 3:
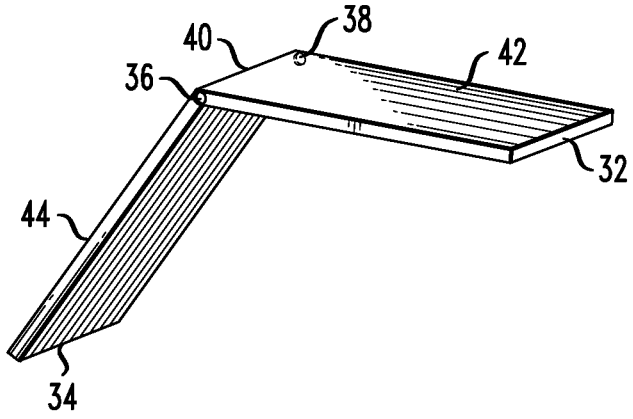
FIG. 3 is an isometric view of the shutter component of the embodiment of FIG. 1.
Figure 6:
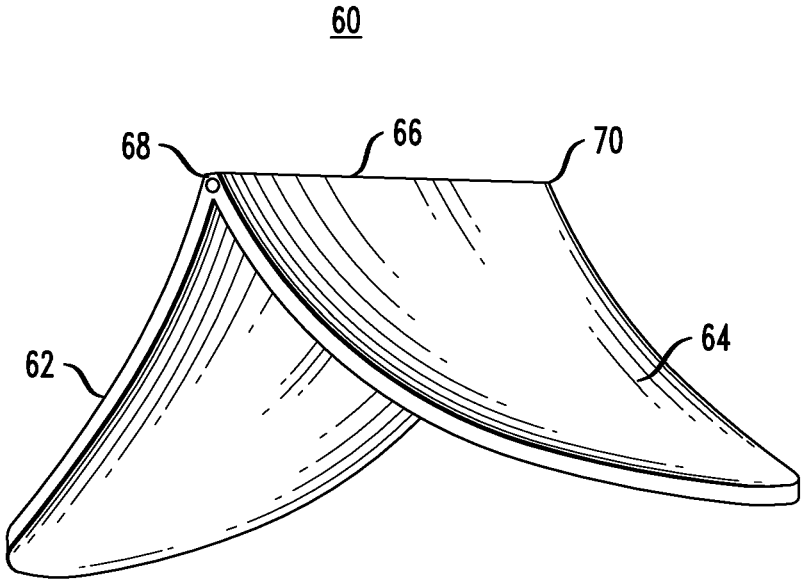
FIG. 6 illustrates an alternative configuration for the shutter component of the embodiment of FIG. 1.

It is to be understood that the inverted-V shaped shutter component of the present invention may comprise any suitable geometry and the "flat plate" geometry of shutter 30 as shown in FIG. 3 is only one exemplary configuration. Indeed, FIG. 6 illustrates an exemplary inverted-V shaped shutter 60 which has a different geometry, in this case comprising a pair of upwardly-flared sides 62 and 64. As with shutter 30, flared sides 62 and 64 are joined along a spine 66 (which forms a horizontal line parallel with bottom termination 20 of base 14 when positioned in place. A pair of apertures 68 and 70 are formed at opposing ends of spine 66 and used to engage flared shutter 60 with pin projections 16-P and 18-P of L-shaped pins 16 and 18, respectively (these projections illustrated in FIG. 2). Moreover, it is to be remembered that the design may be modified such that the apertures are formed on elements 16, 18, with pins included along end terminations of spine 66.

It is contemplated that the utilization of upwardly-flared sides, such as sides 62 and 64, allow for a larger portion of the toilet opening to be obstructed, improving the quality of the user's experience. Indeed, this is only one exemplary alternative, various other designs for the side surfaces of the inverted-V shaped shutter are considered to be merely choices of the user and are considered to fall within the spirit and scope of the present invention.

Figure 7:
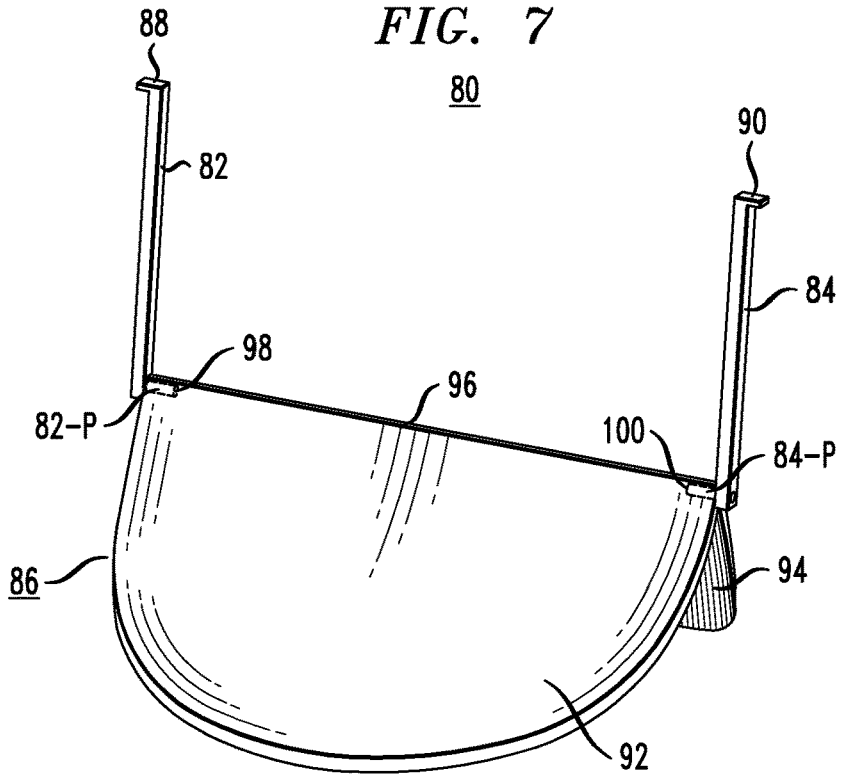
FIG. 7 illustrates another embodiment of the present invention, in this case comprising a bracket-mounted shutter.

FIG. 7 illustrates another embodiment of the present invention. In this case, the shutter support assembly utilizes a pair of extended-length brackets to suspend the shutter in place below the toilet opening. Referring to FIG. 7, an exemplary toilet shutter assembly 80 is shown as comprising a pair of extended-length brackets 82, 84 to support a suspended inverted-V shaped shutter 86. For this specific configuration bracket 82 is formed to include a horizontal pin projection 82-P and bracket 84 is formed to include a similar pin project 84-P, where projections 82-P and 84-P point "inward" and are aligned with each other. Bracket 82 is also shown as including a horizontal flange member 88 that contacts a conventional toilet opening (with bracket 84 containing a similarly-located flange member 90).

Shutter 86 is similar in form and function as shutters 30 and 60 described above. In the particular configuration as shown in FIG. 7, shutter 86 comprises a pair of plates 92, 94 (in this particular configuration having curved outer surfaces) joined along a spine 96. Spine 96 is formed to include opposing end apertures 98 and 100. Thus, similar to the embodiment described above, aperture 98 engages with pin projection 82-P of bracket 82, and aperture 100 engages with pin projection 84-P of bracket 84.

Figure 8:
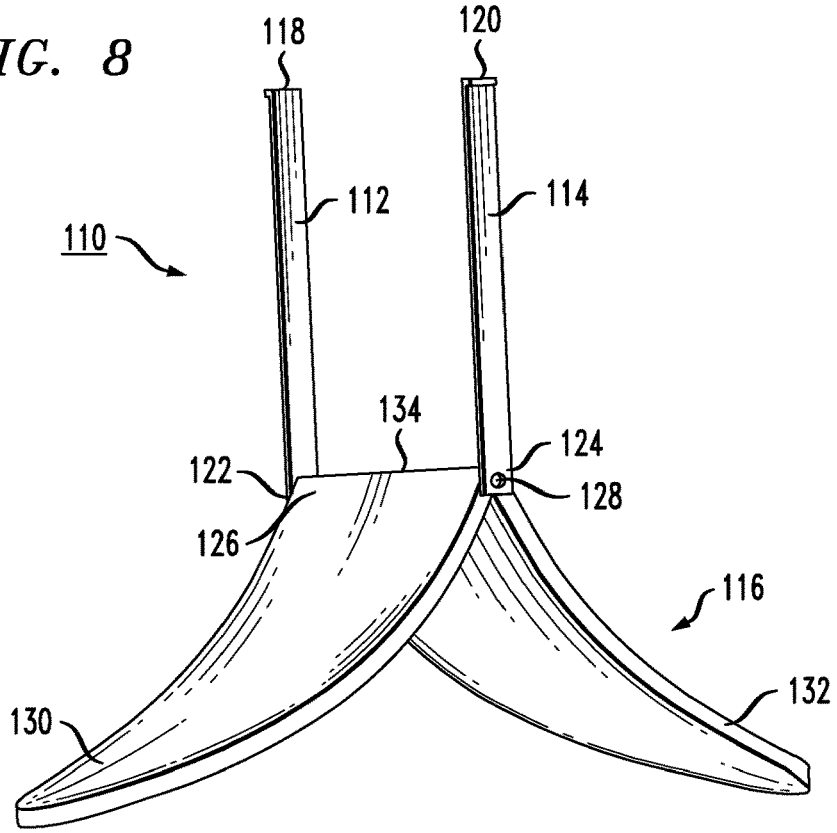
FIG. 8 shows an alternative configuration for the embodiment of FIG. 7.

An alternative configuration of this second embodiment is shown in FIG. 8. In similar fashion to the configuration of FIG. 7, a toilet seat shutter assembly 110 is shown in FIG. 8 as comprising a pair of extended-length brackets 112, 114 that are utilized in conjunction with an inverted-V shaped shutter 116. Bracket 112 includes an upper attachment flange 118 and bracket 114 includes an upper attachment flange 120, where flanges 118 and 120 are used to hold assembly 110 in place within a portable toilet area.

In this particular embodiment, brackets 112, 114 are configured to include apertures near the opposing end terminations, these apertures referred to as 122 and 124 in FIG. 8, with only aperture 124 being visible in this view. Here, shutter 116 itself is formed to include a pair of pin projections 126, 128 that engage with apertures 122, 124 of brackets 112, 114 (only projection pin 128 visible in this view).

As with the various shutter geometries described above, shutter 116 includes a pair of plates 130, 132 connected along a spine 134. Projection pins 126, 128 are formed as extensions of spine 134. In this particular configuration, plates 130 and 132 exhibit a slightly upward curvature. Again, various geometries of shutter plates may be used and the specific design of the plate is considered to be a choice that does not impact the spirit or scope of the present invention.

Moreover, it is to be understood that the extended-bracket second embodiment of the present invention may be formed to include either a "stationary" shutter, or a free-swinging shutter, as discussed above in association with the description of the first embodiment.

While the present invention has been described above in accordance with preferred embodiments, it is to be understood that there may be minor variations to the details of the portable toilet shutter assembly that would be apparent to those skilled in the art. Thus, it is asserted that the spirit and scope of the present invention is only limited by the claims appended hereto.

What is claimed is:

1. A portable toilet shutter apparatus comprising:

a flange assembly for mounting the shutter apparatus in place within an opening of a portable toilet;

an inverted-V shaped shutter suspended underneath the flange assembly so as to block a view of an underlying tank; and a shutter support assembly connected between the flange assembly and the inverted-V shaped shutter for supporting the inverted-V shaped shutter in its suspended position underneath the opening of the portable toilet, wherein the inverted-V shaped shutter is connected to the shutter support assembly in a manner where the shutter remains free to swing while attached to the support assembly.

2. The portable toilet shutter apparatus as defined in claim 1 wherein the inverted-V shaped shutter comprises a pair of plates disposed at a predetermined angle with one another and connected together along adjacent sides to form a spine of the shutter.

3. The portable toilet seat shutter apparatus as defined in claim 2 wherein the pair of plates of the shutter comprise a pair of flat plates.

4. The portable toilet seat shutter apparatus as defined in claim 2 wherein the pair of plates of the shutter comprise a pair of upwardly-curving plates.

5. The portable toilet seat shutter apparatus as defined in claim 2 wherein the shutter further comprises a pair of apertures formed at opposing end terminations of the spine; and the shutter support assembly comprises a pair of horizontal pin projections at opposing locations along a lower termination of the support assembly, wherein the pair of apertures of the shutter engage with the pair of horizontal pin projections to connect the shutter to the shutter support assembly.

6. The portable toilet seat shutter apparatus as defined in claim 1 wherein the shutter support assembly comprises a funnel element connected to the flange assembly and disposed to taper downward and inward therefrom; and a pair of L-shaped pins disposed at a lower termination of the funnel element, wherein the shutter engages with the pair of L-shaped pins to connect the shutter to the shutter support assembly.

7. The portable toilet seat shutter apparatus as defined in claim 1 wherein the shutter support assembly comprises a pair of extended-length brackets connected between the flange assembly and the inverted-V shaped shutter.

8. The portable toilet seat shutter apparatus as defined in claim 7 wherein the inverted-V shaped shutter comprises a pair of plates disposed at a predetermined angle with one another and connected together along adjacent sides to form a spine of the shutter; and the pair of extended-length brackets is connected to opposing end terminations of the spine of the shutter.

9. The portable toilet seat shutter apparatus as defined in claim 8 wherein the inverted-V shaped shutter includes a pair of pin projections disposed at opposing end terminations of the spine; and the pair of extended-length brackets include a pair of apertures disposed to engage with the pair of shutter pin projections to connect the shutter to the shutter support assembly.

10. The portable toilet seat shutter apparatus as defined in claim 8 wherein the inverted-V shaped shutter includes a pair of apertures formed at opposing end terminations of the spine; and the pair of extended-length brackets includes a pair of horizontal pin projections disposed to engage with the pair of shutter apertures to connect the shutter to the shutter support assembly.

* * * * *